US007320553B1

(12) United States Patent
Nunez

(10) Patent No.: US 7,320,553 B1
(45) Date of Patent: Jan. 22, 2008

(54) ELECTRICAL WIRE MARKER

(76) Inventor: Efrem Nunez, 14244 Choco Rd., Apple Valley, CA (US) 92307

( * ) Notice: Subject to any disclaimer, the term of this patent is extended or adjusted under 35 U.S.C. 154(b) by 0 days.

(21) Appl. No.: 11/555,876

(22) Filed: Nov. 2, 2006

Related U.S. Application Data

(60) Provisional application No. 60/732,909, filed on Nov. 3, 2005.

(51) Int. Cl.
*B43K 5/00* (2006.01)
*A46B 11/00* (2006.01)

(52) U.S. Cl. ..... 401/198; 401/10; 401/11

(58) Field of Classification Search ..... 401/9–11, 401/196, 198, 199
See application file for complete search history.

(56) References Cited

U.S. PATENT DOCUMENTS 1,208,865 A * 12/1916 Warwick ..... 401/11
2,527,465 A 10/1950 Toulim, Jr.
3,107,388 A * 10/1963 Groves ..... 401/183
3,352,623 A * 11/1967 Sanet ..... 401/183
3,811,783 A 5/1974 Johnson
4,294,189 A 10/1981 Ashida et al.
4,594,015 A 6/1986 Pomares
5,987,694 A 11/1999 Large
6,280,109 B1 8/2001 Serratore
6,582,142 B2 6/2003 Keller et al.
6,749,356 B1 6/2004 Mead et al.
6,776,548 B2 8/2004 Gardner, Jr. et al.
2003/0124253 A1 7/2003 Kamata et al.
2005/0042019 A1 2/2005 Gaynes et al.

* cited by examiner

*Primary Examiner*—David J. Walczak
(74) *Attorney, Agent, or Firm*—Knobbe, Martens, Olsen & Bear, LLP

(57) ABSTRACT

A liquid marker for marking wires and conductors for identification purposes having a nib with a divergent or a somewhat V-shaped opening so as to be able to accommodate a range of different circumferences of wires.

12 Claims, 4 Drawing Sheets

ELECTRICAL WIRE MARKER

RELATED APPLICATIONS

This application claims the benefit of U.S. Provisional Application No. 60/732,909, filed Nov. 3, 2005, which is hereby incorporated by reference in its entirety herein.

BACKGROUND OF THE INVENTION

1. Field of the Invention

The present invention relates to tools for electricians and electrical workers and, in particular, concerns a marker that allows an electrician or electrical worker to color mark wiring for identification and code compliance purposes.

2. Description of the Related Art

Electrical wiring, which can include both power wiring, communication wiring and the like, often comes in different colors for identification purposes. In fact, the National Electric Code has a specific schedule of colors for wires of specific purposes. For example, ground wires are typically green, neutral wires are typically white and hot wires are typically some color other than green or white. Similarly, telephone wiring also has a standardized color schedule to allow for telephone personnel to identify the appropriate wiring for connection purposes.

While standardized wiring color is very common in many implementations, there are some circumstances where the standardized wiring colors are not used. For example, with equipment that is manufactured in foreign countries, the wiring of that equipment may not follow the same standardized color schedule that is used in the United States. Further, even wiring that is done in the United States is often done using non-standardized wiring colors. For example, sometimes wiring is all of a single color or a limited number of colors for aesthetic or other purposes which makes identification of specific wires more difficult.

For those individuals that are installing equipment or repairing equipment, there is thus a need for a way to mark wire for identification purposes. Sometimes non-standardized color wire will have to be marked for compliance with local building codes and other times the wires are simply marked by an electrician or installer to aid in subsequent identification of wiring for repair and replacement purposes. In either circumstance, it is often desirable to be able to color the insulation of the wiring with a desired color either to match the required code color or for simple identification purposes.

One example of a device that can be used for marking wiring is disclosed in U.S. Pat. No. 6,280,109 to Serratore. Serratore discloses a marker that has two openings including a smaller cylindrical opening and an open ended semi-cylindrical opening. However, both of the cylindrical openings in the Serratore patent have a single fixed circumference and, as such, are suitable for marking only wires with a corresponding outer circumference. Thus, electricians have to carry many different markers, not just markers of different colors, but also markers having different size openings, to be able to adequately mark wiring. For many workers, this is both cumbersome and inefficient.

Moreover, Serratore uses a standard felt-type nib like those used in ink pens. Such felt-type nibs are very suitable for applying ink to paper, however, these types of nibs are less suitable when applying thicker paint-type substances to harder and uneven wiring insulation and conductors as required in this particular application. Specifically, felt-type nibs generally have much smaller openings as ink is usually less viscous than paint. However, applying standard ink to non-absorbent materials like wiring insulation is not particularly effective for marking wiring for long periods of time as the ink does not adhere well and can also fade or come off over time. The use of felt-type nibs for applying paint is usually problematic as the felt-type nib can become more quickly clogged with paint. Further, the wiring insulation is harder and can often be rough which can result in damage to the softer felt-type nib.

Hence, there is a need for an improved way of being able to mark insulation and/or conductors of wiring with specific colors. To this end, there is a need for a marker that has a nib that can accommodate a greater range of diameters of wiring and a nib that is formed of a material that allows for more durable colored substances, such as paint, to be applied to wiring where the nib is resistant to damage as a result of application to uneven surfaces.

SUMMARY OF THE INVENTION

The aforementioned needs are satisfied by the wiring marker of the present invention which, in one implementation, comprises a shaft which houses a reservoir that contains a liquid colored substance. In this implementation, the marker further comprises a nib that is in fluid communication with the reservoir so as to receive the colored substance therefrom. The nib in this particular implementation has a distal surface having an opening formed therein. The opening has a bottom surface and two lateral side walls wherein the two lateral side walls are slanted so as to extend away from each other as the interior side walls extend toward the distal end of the nib.

The shape and configuration of the internal side walls of the opening allows wiring having a greater range of diameters to be marked by the marker as the distance between the slanted inner side walls increases over the depth of the opening. Thus, the marker in this particular implementation can be used to mark a greater range of circumferences of wiring without requiring the use of multiple markers.

In another implementation, the nib of the marker is formed of a deformable plastic material rather than a felt cloth material as the deformable plastic material is more resistant to abrasion and damage when being applied to hard wiring insulation. In one particular implementation, the nib is formed of a fiber polymer plastic and, in one very specific implementation, it is a porous plastic such as polyethylene having a pore size of 60-120 microns. In this particular specific implementation, the pore size is selected so as to allow a paint, such as a xylene-based paint selected for its elasticity and drying time, to be readily applied via the marker.

The foregoing implementations of the marker of the present invention provide a more versatile marker that can be used with a greater variety of wiring sizes and also a more durable marker due to the improvement of the configuration of the nib and the materials used to form the nib. These and other objects and advantages of the present invention will become more apparent from the following description taken in conjunction with the accompanying claims.

DETAILED DESCRIPTION OF THE PREFERRED EMBODIMENT

Figure 1A:
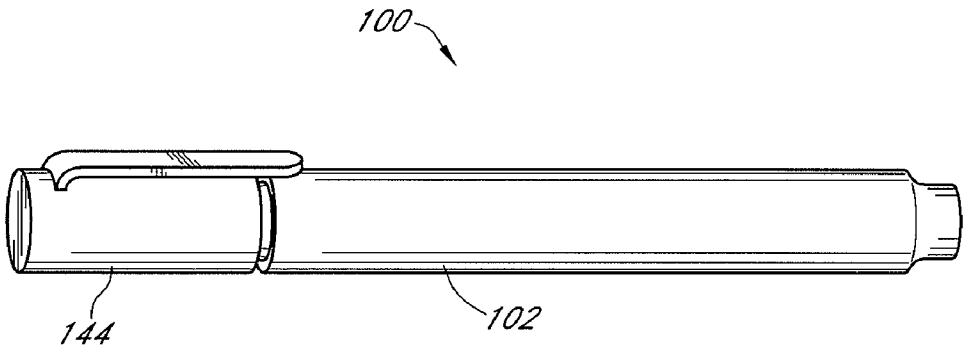
FIG. 1A is a perspective view of one exemplary wiring marker of the illustrated embodiments.
Figure 1B:
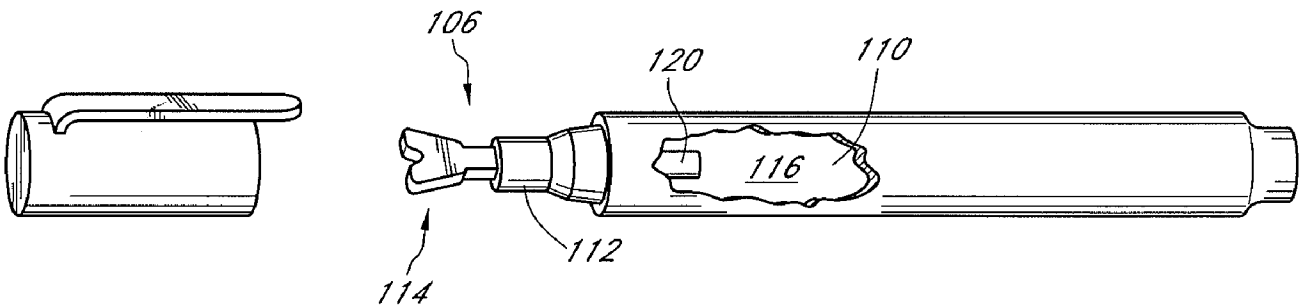
FIG. 1B is a partially cut-away view of the marker of FIG. 1A illustrating the configuration of the nib and a marking liquid reservoir.

Reference will now be made to the drawings wherein like numerals refer to like parts throughout. As is illustrated in FIGS. 1A and 1B, a wiring marker 100 of the illustrated embodiment is shown. The wiring marker 100 includes a barrel section 102 that includes a reservoir 110 that contains a marker liquid 116, such as paint or ink, that will be described in greater detail below.

As is also illustrated in FIGS. 1A and 1B, the marker includes a nib assembly 106 that includes a nib member 114 that extends out of a first end of the barrel 102 of the marker 100. In this implementation, there is a cap 144 which is adapted to couple with the first end of the barrel 102 so as to limit exposure of the nib 114 to air when not in use. The nib assembly 106 includes a liquid end 120 that extends through the first end of the barrel 102 in a known manner so as to be positioned within the reservoir 110 such that liquid marker material 116 in the reservoir 110 can be transmitted through the nib assembly 106 to the nib member 114 in a known manner to allow for subsequent application to a wire in a manner that will be described in greater detail below.

Figure 2:
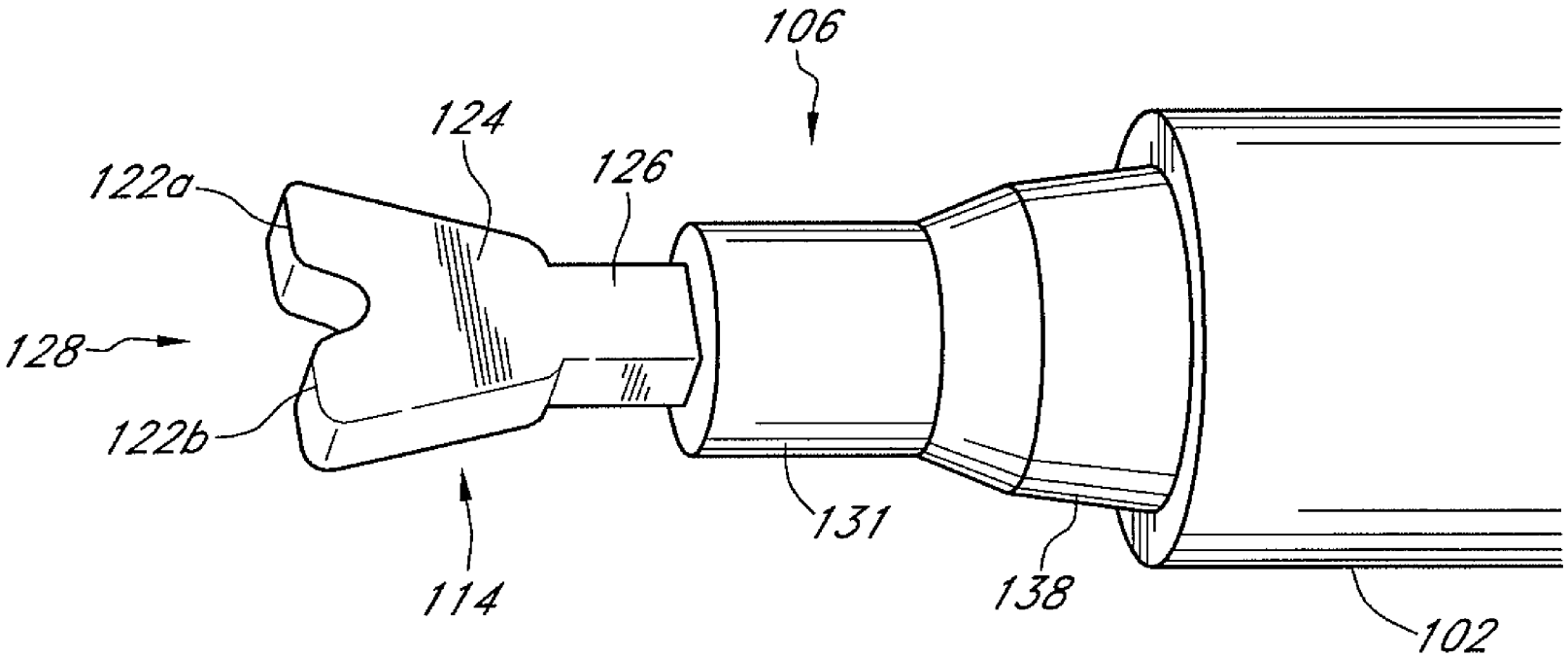
FIG. 2 is a close-up perspective view of the nib of the marker of FIGS. 1A and 1B.

FIG. 2 is a close-up illustration of the nib assembly 106. The nib member 114 has two arms 122*a*, 122*b* that extend outward from a main portion 124. The arms extend in a generally divergent direction such that an opening 128 is formed between the arms 122*a*, 122*b* at the distal end of the nib member 114. As shown, the side walls of the opening 128 are laterally spaced from one another in a somewhat V-shaped fashion. The base portion 124 of the nib member 114 is coupled to the liquid nib end 120 (See, FIG. 1B) via an interconnection section 126 which extends into a circular protrusion 131 that is coupled to the barrel member 102 via a coupler 138. The interconnection between the nib member 114 and the reservoir 110 through the barrel member 102 is accomplished in any of a number of ways known in the art.

Figure 3B:
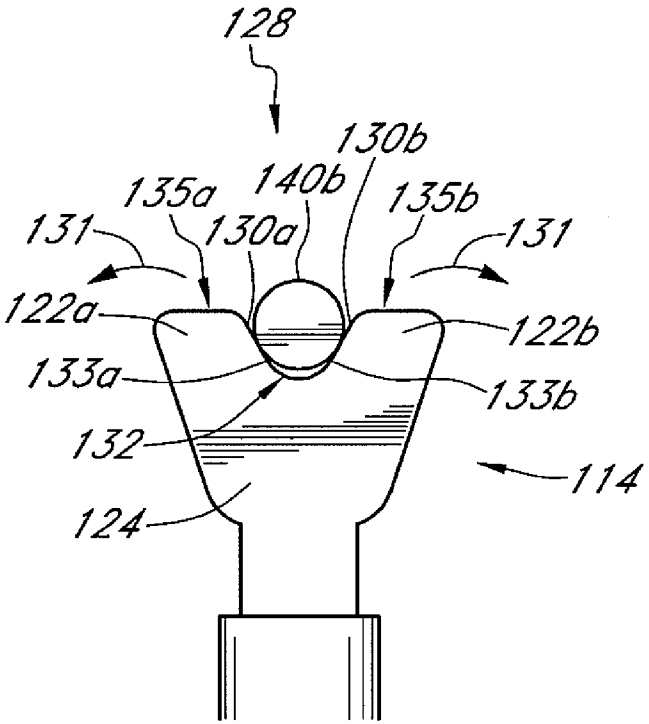
FIGS. 3A and 3B are sectional views of the nib illustrating how the marker can be used with wiring of different sizes.
Figure 3A:
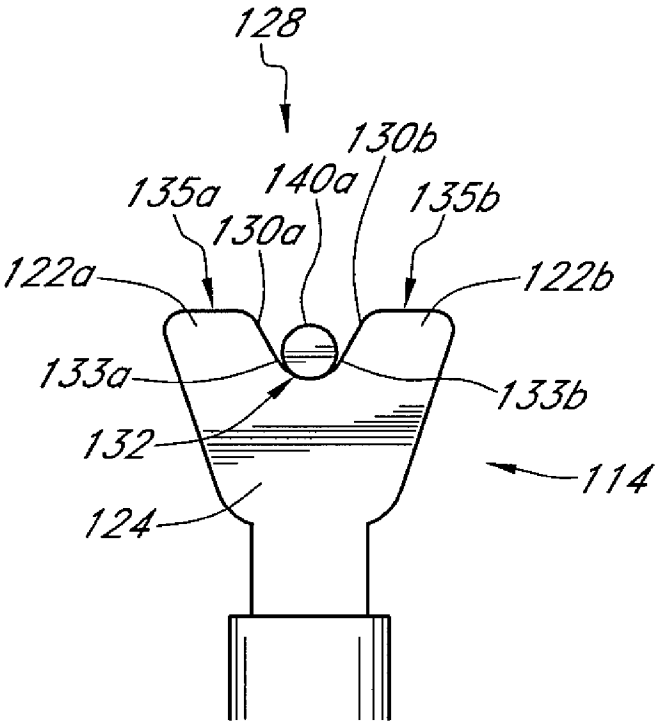

The configuration of the nib member 114 and the opening 128 is shown in greater detail with respect to FIGS. 3A and 3B. More specifically, each of the arms 122*a*, 122*b* extend outwardly from each other such that the interior surfaces 130*a*, 130*b* of the opening 128 are diverging. The bottom surface 132 of the opening 128, in this implementation, is rounded in the manner shown in FIG. 3A so as to allow for easier marking of a round conductor, such as a wire. The divergent inner walls 130*a*, 130*b* of the opening 128 of the nib member 114 allows the nib member 114 to accommodate a range of different diameter wires 140*a*, 140*b* as is exemplified by the illustration of FIGS. 3A and 3B. Moreover, since the nib member 114 is preferably made of a somewhat deformable substance, application of pressure when a conductor 140*a*, 140*b* is positioned within the opening 128 will result in the larger conductor 140*b* contacting the bottom surface 132 of the opening 128 as the arms 122*a*, 122*b* will be forced outward as represented by the arrows 131.

Because the upper ends of the interior surfaces 130*a*, 130*b* of the arms 122*a*, 122*b* are spaced further apart than the interior ends, a range of diameter of conductors can be used with a single nib. More specifically, larger diameter conductors are more easily accommodated by the wider opening 128 between the arms 122*a*, 122*b* of the nib member 114. The conductor can be urged downward into the opening 128 to where the inner side walls 130*a*, 130*b* contact the outer circumference of the wiring such that marker liquid can be applied to the outer surface of the conductors via the inner side walls 130*a*, 130*b* and the rounded bottom surface 132 of the opening 128 in the nib member.

In one particular implementation, the opening 128 in the nib member 114 is approximately 0.120" deep and that the bottom ends 133*a*, 133*b* of the inner surfaces 130*a*, 130*b* are approximately 0.127" apart with the upper end 135*a*, 135*b* of the inner surfaces 130*a*, 130*b* being approximately 0.263" apart. Thus, in this particular implementation, a single marker can accommodate wiring or gages of conductors of a range of approximately 18 awg to 2 awg. It will be appreciated that by varying the distance between the lower ends 133*a*, 133*b* and the upper ends 135*a*, 135*b* of the interior surfaces 130*a*, 130*b* of the opening 128, a wide variety of different conductors can be marked using the marker 100 of the illustrated embodiment.

In one particular implementation, the nib member 114 is formed of a fiber polymer plastic material, such as those found in common children's play markers, and it has a pore size of approximately 60 to 120 microns. The use of the fiber polymer plastic material results in a nib that is substantially more resistant to wear when applying the marking liquid to rough surfaces or uneven surfaces than a cloth material. Moreover, using this material with this particular pore size further allows for more uniform application of liquid marking material, such as a xylene-based marking material, which is highly elastic and has a relatively quick drying time. One particular xylene-based marking material that would be used is a xylene-based permanent pigmented ink available from National Ink located in Santee, Calif.

Figure 4:
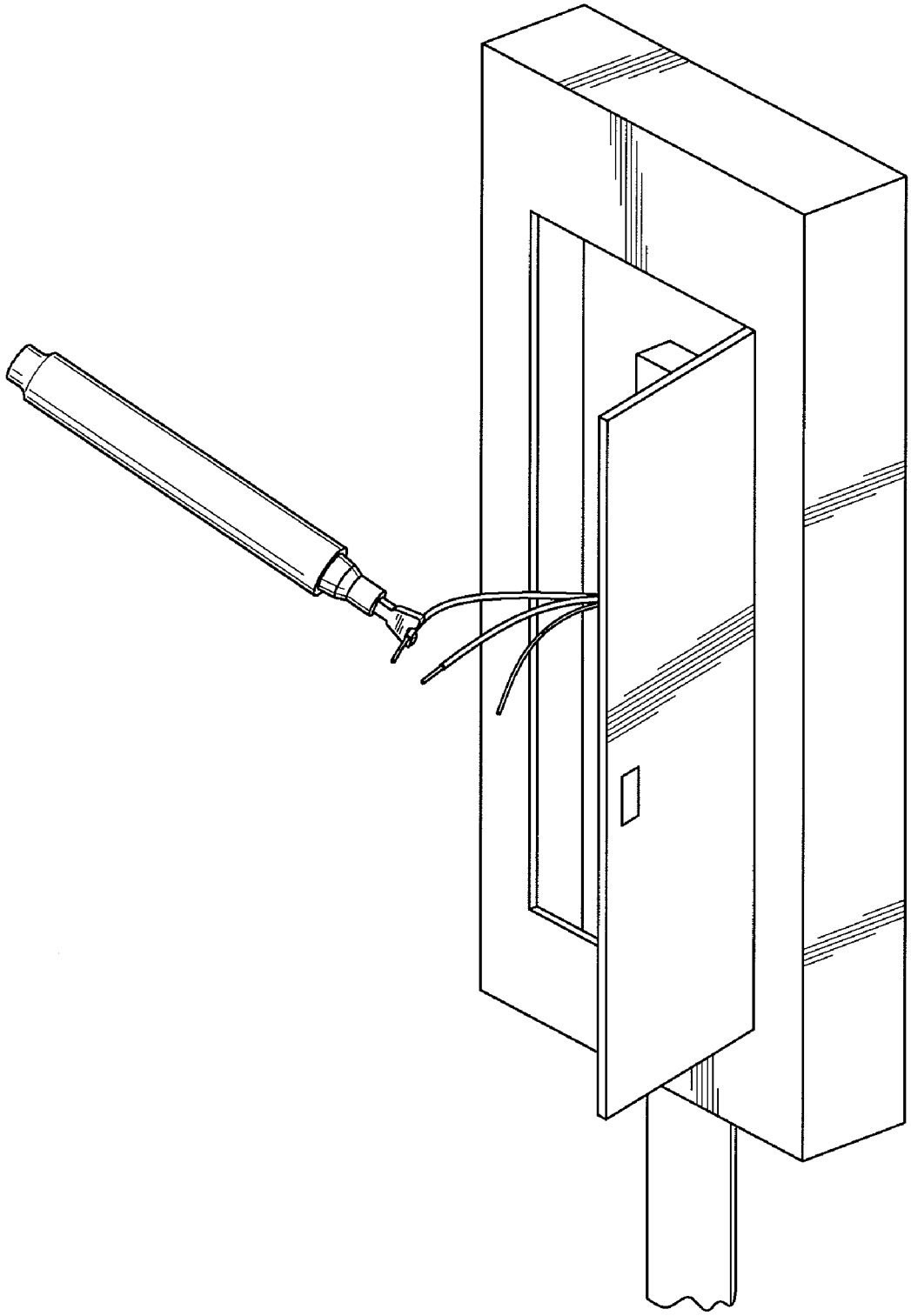
FIG. 4 is a perspective view of the marker illustrating its manner of use in marking wires.

FIG. 4 shows an exemplary illustration of the application of the marker to the conductor. The insulation material is positioned within the opening 128 and the marker is then pressed against the insulation material of the conductor such that the marker liquid can then be applied to the insulation to thereby change the color of the insulation. Either the marker can be used with a single stroke to apply a stripe of insulation or to color some fraction of the outer circumference of the insulation or, through the use of multiple strokes, the entire outer insulation of at least a section of the wire can be colored. The use of a marker having the opening in the nib with the two divergent arms results in a single marker being capable of being used to mark a range of different wire sizes. Consequently, electricians or other people in the field who are marking wires do not have to carry as many markers in order to mark wires for identification or code compliance purposes. Further, the use of a fiber polymer plastic material for the nib results in a marker that is longer lasting and has greater versatility for individuals using the marker in the field.

While certain embodiments of the invention have been described, these embodiments have been presented by way of example only, and are not intended to limit the scope of the invention. Indeed, the novel methods and systems described herein may be embodied in a variety of other forms, furthermore, various omissions, substitutions and changes in the form of the methods and systems and devices described herein may be made by those skilled in the art without departing from the spirit of the present invention. The accompanying claims and their equivalents are intended to cover such forms or modifications that will fall within the scope and spirit of the invention.

What is claimed is:

1. A marker for marking wiring for identification purposes, the marker comprising:

a shaft having a reservoir positioned therein, wherein the reservoir contains a marking liquid material; and a nib assembly that is in fluid communication with the reservoir so as to be able to receive the marking liquid material wherein the nib assembly has a distal end with an opening formed therein which extends in to the nib assembly to an inner end wherein the opening defines two lateral arms having inner walls adjacent the opening and wherein the opening is formed such that the inner walls of the two lateral arms in the opening are divergent and form a generally V-shaped opening with a rounded bottom such that conductors having a range circumferences can be positioned within the opening such that the outer surface of the conductors contact the inner walls of the two lateral arms such that the marking liquid material can be applied to the outer surface of the conductor via the inner walls of the two lateral arms.

2. The marker of claim 1, wherein the opening in the nib member is approximately 0.127" wide at the inner end and approximately 0.263" wide at the distal end.

3. The marker of claim 2, wherein the inner end of the opening is rounded so as to be able to more easily apply marking liquid material to a conductor having a rounded circumference.

4. The marker of claim 1, wherein the nib assembly is formed of a fiber polymer plastic material having a plurality of pores to allow the liquid marker material to be transmitted therethrough from the reservoir to the inner surfaces of the opening.

5. The marker of claim 4, wherein the nib assembly is formed of a fiber polymer material having pores with an average size of 60-120 microns.

6. The marker of claim 4, wherein the marking liquid material comprises a xylene-based permanent pigmented ink.

7. A marker for marking wiring for identification purposes, the marker comprising:

a shaft having a reservoir positioned therein, wherein the reservoir contains a marking liquid material; and a nib assembly that is in fluid communication with the reservoir so as to be able to receive the marking liquid material wherein the nib assembly has a distal end with an opening formed therein which extends into the nib assembly to an inner end wherein the opening defines a generally V-shaped opening with a rounded bottom having two inner surfaces such that an outer surface of a conductor is adapted to contact the two inner surfaces and wherein the nib assembly is formed of a fiber polymer plastic material having a plurality of pores such that the marking liquid material is transmitted through the nib assembly so as to be applied to the outer surface of the conductor via the inner walls of the two inner surfaces.

8. The marker of claim 7, wherein the opening formed in the nib assembly extends into the nib assembly to the inner end wherein the opening is formed such that the inner surfaces in the opening are divergent such that conductors having a range of circumferences can be positioned within the opening such that the outer surface of the conductors contact the inner surfaces such that the marking liquid material can be applied to the outer surface of the conductor via the inner surfaces.

9. The marker of claim 7, wherein the opening in the nib member is approximately 0.263" wide at the distal end and approximately 0.127" wide at the inner end.

10. The marker of claim 9, wherein the inner end of the opening is rounded so as to be able to more easily apply marking liquid material to a conductor having a rounded circumference.

11. The marker of claim 7, wherein the nib assembly is formed of a fiber polymer material having pores with an average size of 60-120 microns.

12. The marker of claim 7, wherein the marking liquid material comprises a xylene based permanent pigmented ink.

* * * * *